US011209753B2

(12) United States Patent
Lee et al.

(10) Patent No.: US 11,209,753 B2
(45) Date of Patent: Dec. 28, 2021

(54) TONER REFILL CARTRIDGE WITH EXTENDABLE PLUNGER

(71) Applicant: Hewlett-Packard Development Company, L.P., Spring, TX (US)

(72) Inventors: Sang-Hoon Lee, Seongnam-si (KR); Joon-Hee Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,124

(22) PCT Filed: Feb. 28, 2019

(86) PCT No.: PCT/US2019/019992
§ 371 (c)(1),
(2) Date: Oct. 20, 2020

(87) PCT Pub. No.: WO2020/046418
PCT Pub. Date: Mar. 5, 2020

(65) Prior Publication Data

US 2021/0240107 A1 Aug. 5, 2021

(30) Foreign Application Priority Data

Aug. 30, 2018 (KR) ..... 10-2018-0102568

(51) Int. Cl.
*G03G 15/08* (2006.01)

(52) U.S. Cl.
CPC ..... *G03G 15/0894* (2013.01); *G03G 15/0867* (2013.01)

(58) Field of Classification Search
CPC ..... G03G 15/0894; G03G 15/0867; G03G 15/0865; G03G 2215/066; G03G 2215/0673
See application file for complete search history.

(56) References Cited

U.S. PATENT DOCUMENTS 4,273,877 A 6/1981 Anagnostopoulos
5,593,068 A * 1/1997 Kitayama ..... G03G 15/0867 141/364

(Continued)

FOREIGN PATENT DOCUMENTS

CN 103959176 A 7/2014
JP 3-54962 U 5/1991

(Continued)

*Primary Examiner* — Sandra Brase
(74) *Attorney, Agent, or Firm* — Jefferson IP Law, LLP

(57) ABSTRACT

A toner refill cartridge includes a main body including an inner space in which toner is received and a toner discharge portion through which the toner is discharged, a piston coupled to the main body to be movable in a first direction along the inner space and configured to push the toner to the outside of the main body through the toner discharge portion, a plunger configured to push the piston in the first direction, the plunger including a plurality of segment members. At least two adjacent segment members are switchable from a retraction state where the at least two adjacent segment members overlap each other in the first direction and an extension state where the at least two adjacent segment members extend in a second direction opposite to the first direction. A first locking portion locks the at least two adjacent segment members in the extension state.

15 Claims, 9 Drawing Sheets

(56) References Cited

U.S. PATENT DOCUMENTS

| | | | | |
|---|---|---|---|---|
| 5,663,754 | A | 9/1997 | Lorenze, Jr. et al. | |
| 5,673,073 | A | 9/1997 | Childers et al. | |
| 5,706,870 | A | 1/1998 | Maerzke | |
| 6,862,420 | B1 | 3/2005 | Less | |
| 2012/0014713 | A1* | 1/2012 | Murakami | G03G 15/0867 399/119 |
| 2013/0046238 | A1* | 2/2013 | Edhouse | A61M 5/20 604/134 |
| 2014/0169836 | A1* | 6/2014 | Nagashima | G03G 15/0865 399/258 |

FOREIGN PATENT DOCUMENTS

| | | | |
|---|---|---|---|
| JP | 6-222663 | A | 8/1994 |
| JP | 2003-29516 | A | 1/2003 |

* cited by examiner

TONER REFILL CARTRIDGE WITH EXTENDABLE PLUNGER

BACKGROUND

A printer using an electrophotographic method forms a visible toner image on a photoconductor by supplying toner to an electrostatic latent image formed on the photoconductor, transfers the toner image to a print medium directly or through an intermediate transfer medium, and then fixes the transferred toner image on the print medium.

A development cartridge receives toner and supplies toner to the electrostatic latent image formed on the photoconductor to form a visible toner image. When the development cartridge runs out of toner, the development cartridge may be removed from a main body of a printer and a new development cartridge may be mounted on the main body of the printer. The development cartridge may also be refilled with new toner by using a toner refill kit (e.g., a toner cartridge).

DETAILED DESCRIPTION

Figure 1:
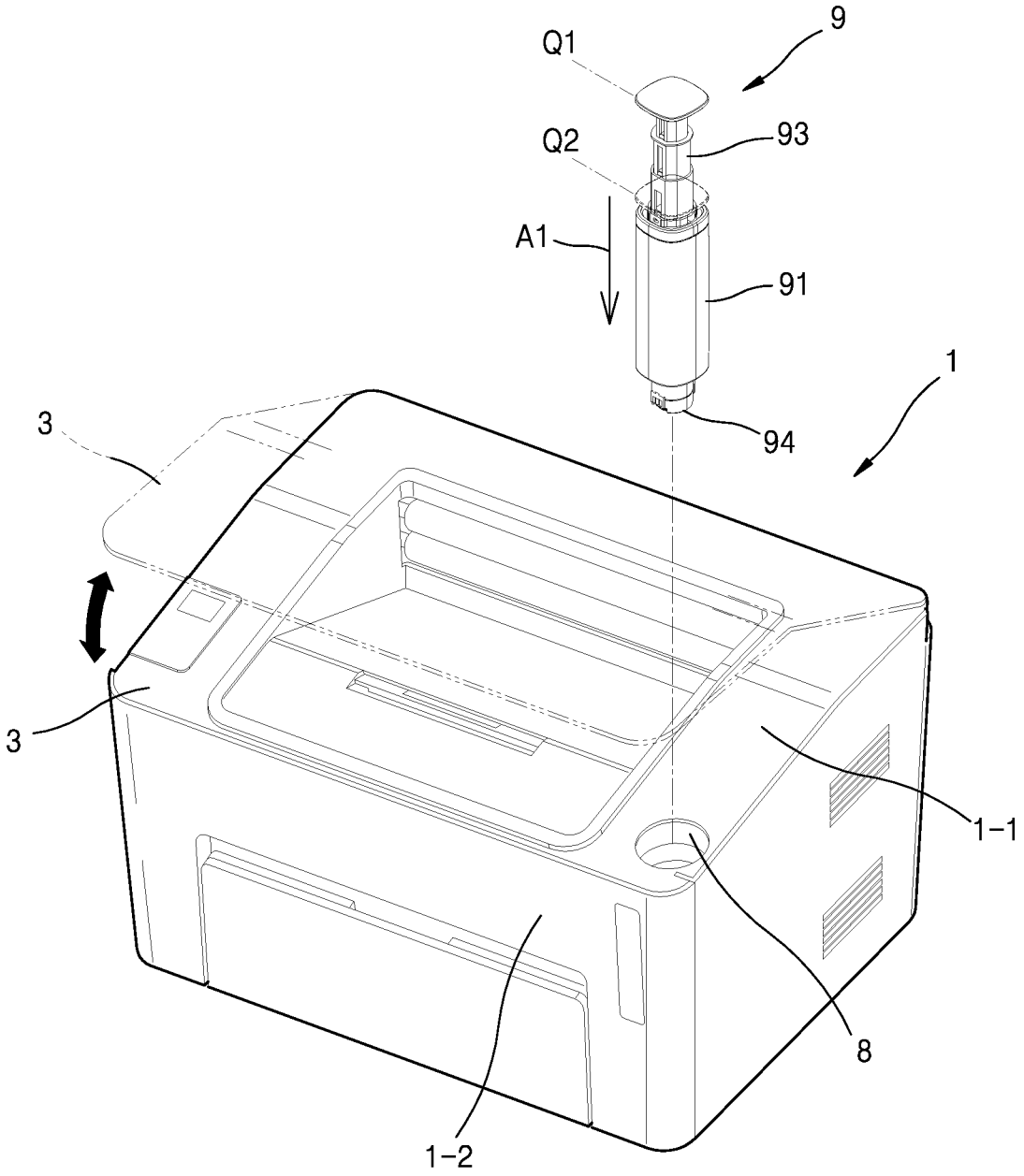
FIG. 1 is a perspective view illustrating an outer appearance of an electrophotographic printer according to an example.
Figure 2:
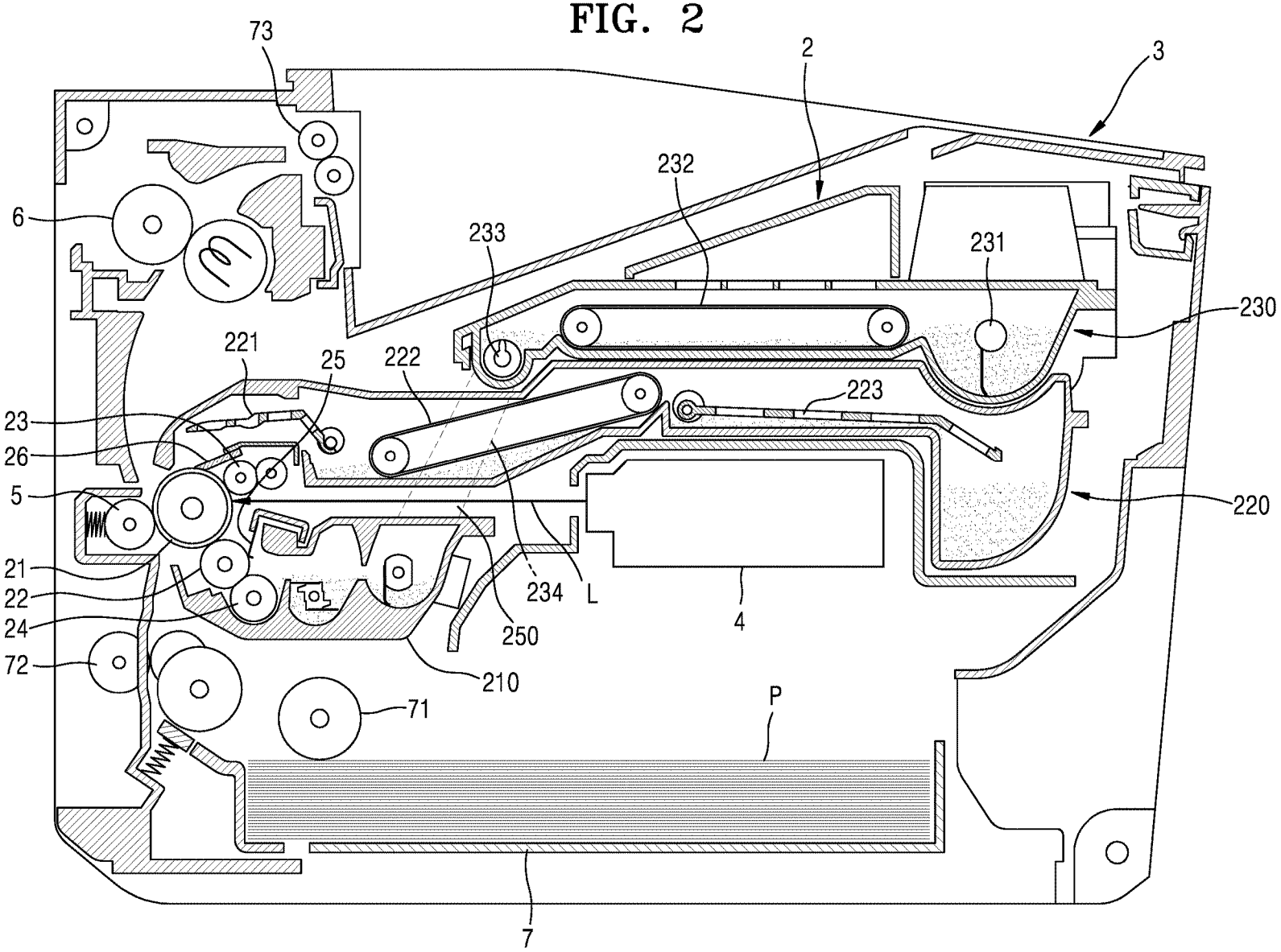
FIG. 2 is a view illustrating a configuration of the electrophotographic printer of FIG. 1, according to an example.
Figure 3:
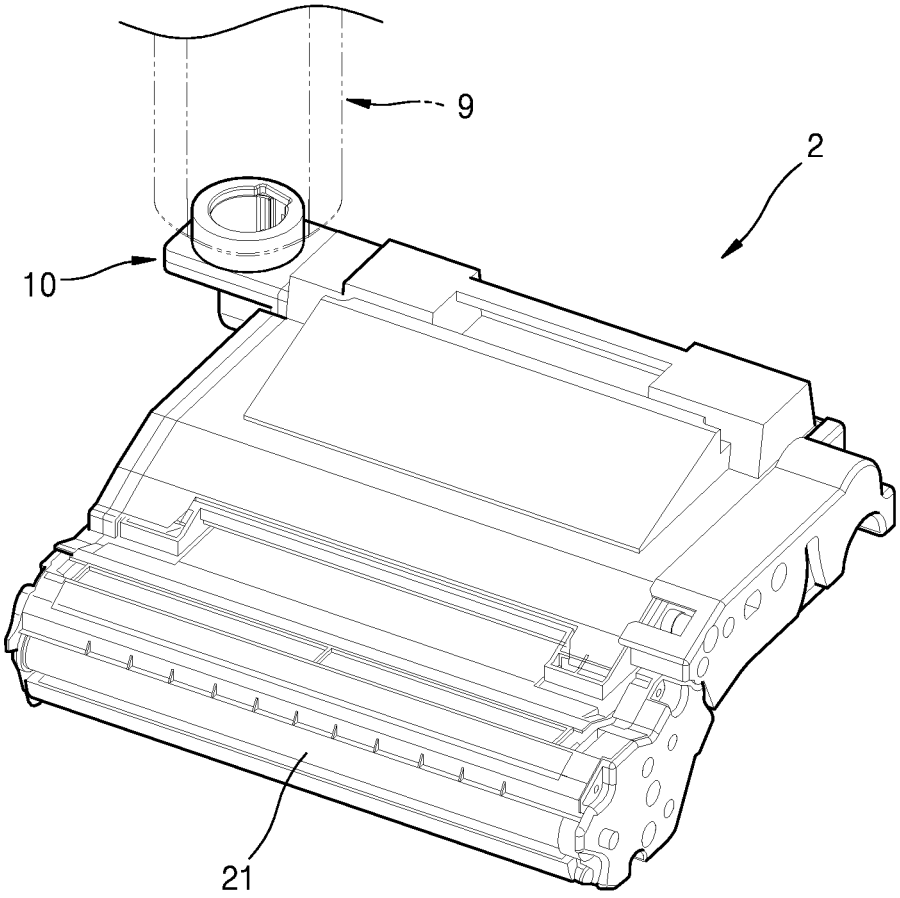
FIG. 3 is a perspective view of a development cartridge used in the electrophotographic printer of FIG. 1, according to an example.

FIG. 1 is a perspective view illustrating an outer appearance of an electrophotographic printer according to an example. FIG. 2 is a view illustrating a configuration of the electrophotographic printer of FIG. 1, according to an example. FIG. 3 is a perspective view of a development cartridge used in the electrophotographic printer of FIG. 1, according to an example. Referring to FIGS. 1, 2, and 3, a printer may include a main body 1 and a development cartridge 2 attachable to/detachable from the main body 1. A door 3 may be provided on the main body 1. The door 3 opens/closes a portion of the main body 1. Although the door 3 opens an upper portion of the main body 1 in FIG. 1, a door for opening a side portion of the main body 1 or a front portion of the main body 1 may be used, if necessary. The door 3 may be opened and the development cartridge 2 may be attached to/detached from the main body 1.

A photosensitive drum 21 that is a photoconductor on which an electrostatic latent image is formed may include a cylindrical metal pipe and a photosensitive layer having photoconductivity and formed on an outer circumferential surface of the cylindrical metal pipe. A charging roller 23 is a charger for charging a surface of the photosensitive drum 21 to a uniform electric potential. A charging bias voltage is applied to the charging roller 23. A corona charger (not shown), instead of the charging roller 23, may be used. A developing roller 22 supplies toner to the electrostatic latent image formed on the surface of the photosensitive drum 21 and develops the electrostatic latent image.

When a two-component development method using toner and a carrier as a developer is used, the developing roller 22 may include a rotating sleeve and a magnet fixedly located inside the rotating sleeve. The rotating sleeve may be spaced apart from the photosensitive drum 21 by tens to hundreds of micrometers. The carrier is attached to an outer circumferential surface of the developing roller 22 due to a magnetic force of the magnet, and the toner is attached to the carrier due to an electrostatic force, and thus a magnetic brush formed of the carrier and the toner is formed on the outer circumferential surface of the developing roller 22. The toner is moved to the electrostatic latent image formed on the photosensitive drum 21 due to a developing bias voltage applied to the developing roller 22.

When a one-component development method using toner as a developer is used, the developing roller 22 may contact the photosensitive drum 21, or may be spaced apart from the photosensitive drum 21 by tens to hundreds of micrometers. In the example, a one-component development method in which a development nip is formed when the developing roller 22 and the photosensitive drum 21 contact each other is used. The developing roller 22 may include a conductive metal core (not shown) and an elastic layer (not shown) formed on an outer circumferential surface of the conductive metal core. When a developing bias voltage is applied to the developing roller 22, the toner is moved and attached to the electrostatic latent image formed on the surface of the photosensitive drum 21 through the development nip.

A supply roller 24 allows toner to be attached to the developing roller 22. A supply bias voltage may be applied to the supply roller 24 so that toner is attached to the developing roller 22. Reference numeral 25 denotes a regulating member for regulating the amount of toner attached to a surface of the developing roller 22. The regulating member 25 may be a regulating blade whose front end contacts the developing roller 22 at a predetermined pressure. Reference numeral 26 denotes a cleaning member for removing residual toner and a foreign material from the surface of the photosensitive drum 21 before a charging operation. The cleaning member 26 may be a cleaning blade whose front end contacts the surface of the photosensitive drum 21. Hereinafter, the foreign material removed from the surface of the photosensitive drum 21 is referred to as waste toner.

An optical scanner 4 scans light modulated according to image information to the surface of the photosensitive drum 21 charged to a uniform electric potential. A laser scanning unit (LSU) deflecting light emitted from a laser diode in a main scanning direction by using a polygon mirror and scanning the deflected light to the photosensitive drum 21 may be used as the optical scanner 4.

A transfer roller 5 is a transfer unit facing the photosensitive drum 21 and configured to form a transfer nip. A transfer bias voltage for transferring the toner image developed on the surface of the photosensitive drum 21 to a print medium P is applied to the transfer roller 5. A corona transfer unit, instead of the transfer roller 5, may be used.

The toner image transferred to a surface of the print medium P by the transfer roller 5 is maintained on the surface of the print medium P due to electrostatic attraction. A fuser 6 forms a permanent print image on the print medium P by fixing the toner image onto the print medium P by applying heat and pressure.

Referring to FIGS. 2 and 3, the development cartridge 2 of the example includes a developing portion 210 in which the photosensitive drum 21 and the developing roller 22 are provided, a waste toner container 220 in which waste toner removed from the photosensitive drum 21 is received, and a toner container 230 connected to the developing portion 210 and allowing toner to be received therein. In order to refill the toner container 230 with toner, the development cartridge 2 includes a toner refilling portion 10 connected to the toner container 230. The toner refilling portion 10 provides an interface between a toner refill cartridge 9 and the development cartridge 2. The development cartridge 2 is an integrated development cartridge including the developing portion 210, the waste toner container 220, the toner container 230, and the toner refilling portion 10.

A portion of an outer circumferential surface of the photosensitive drum 21 is exposed to the outside of a housing. The transfer roller 5 contacts the exposed portion of the photosensitive drum 21 to form a transfer nip. At least one conveying member for conveying toner to the developing roller 22 may be provided on the developing portion 210. The conveying member may agitate the toner and may charge the toner to a predetermined electric potential.

The waste toner container 220 is located over the developing portion 210. The waste toner container 220 is spaced apart from the developing portion 210 so that a light path 250 is formed between the waste toner container 220 and the developing portion 210. Waste toner removed from the photosensitive drum 21 by the cleaning member 26 is received in the waste toner container 220. The waste toner removed from the surface of the photosensitive drum 21 is transported into the waste toner container 220 by one or more waste toner transporting members 221, 222, and 223. Shapes and the number of waste toner transporting members are not limited. An appropriate number of waste toner transporting members may be provided at appropriate positions in order to effectively disperse the waste toner in the waste toner container 220 considering a volume or a shape of the waste toner container 220.

The toner container 230 is connected to the toner refilling portion 10 and receives toner. The toner container 230 is connected to the developing portion 210 by a toner supply portion 234 as marked by a dashed line of FIG. 2. As shown in FIG. 2, the toner supply portion 234 may vertically pass through the waste toner container 220 and may be connected to the developing portion 210. The toner supply portion 234 is located outside an effective width of exposure light L in order not to interfere with the exposure light L scanned in the main scanning direction by the optical scanner 4.

One or more toner supply members 231, 232, and 233 for supplying toner through the toner supply portion 234 to the developing portion 210 may be provided in the toner container 230. Shapes and the number of toner supply members are not limited. An appropriate number of toner supply members may be provided at appropriate positions in the toner container 230 in order to effectively supply the toner to the developing portion 210 considering a volume or a shape of the toner container 230. The toner supply member 233 may convey the toner in the main scanning direction to the toner supply portion 234.

An image forming process will now be described briefly. A charging bias voltage is applied to the charging roller 23, and the photosensitive drum 21 is charged to a uniform electric potential. The optical scanner 4 forms an electrostatic latent image on a surface of the photosensitive drum 21 by scanning light modulated to correspond to image information to the photosensitive drum 21. The supply roller 24 allows toner to be attached to a surface of the developing roller 22. The regulating member 25 forms a toner layer having a uniform thickness on the surface of the developing roller 22. A developing bias voltage is applied to the developing roller 22. As the developing roller 22 rotates, the toner conveyed to a development nip is moved and attached to the electrostatic latent image formed on the surface of the photosensitive drum 21 due to the developing bias voltage and a visible toner image is formed on the surface of the photosensitive drum 21. The print medium P picked up from a loading tray 7 by a pickup roller 71 is fed by a feed roller 72 to a transfer nip where the transfer roller 5 and the photosensitive drum 21 face each other. When a transfer bias voltage is applied to the transfer roller 5, the toner image is transferred to the print medium P due to electrostatic attraction. The toner image transferred to the print medium P is fixed onto the print medium P due to heat and pressure applied by the fuser 6, thereby completing a printing operation. The print medium P is discharged by a discharge roller 73. A portion of the toner remaining on the surface of the photosensitive drum 21 without being transferred to the print medium P is removed by the cleaning member 26.

As described above, the development cartridge 2 may form a visible toner image by supplying toner received in the toner container 230 to an electrostatic latent image formed on the photosensitive drum 21 and may be attached/detached to/from the main body 1. Also, the development cartridge 2 includes the toner refilling portion 10 for refilling toner. The toner refilling portion 10 may be integrally formed with the development cartridge 2 and may be detachably attached to the main body 1 along with the development cartridge 2. According to the example, the development cartridge 2 may be refilled with toner in a state where the development cartridge 2 is mounted on the main body 1, without being removed from the main body 1.

Referring to FIG. 1, the tone refill cartridge 9 may be a syringe-type toner refill cartridge including a main body 91 configured to receive toner therein and including a toner discharge portion 94, and a plunger 93 coupled to the main body 91 to be movable in a first direction A1 and configured to push the toner to the outside of the main body 91. The toner discharge portion 94 may be provided on a front end portion of the main body 91. A discharge shutter (not shown) for selectively opening/closing the toner discharge portion 94 may be provided on the front end portion of the main body 91.

A communicating portion 8 is formed in the main body 1 so as to access the toner refilling portion 10 from the outside of the main body 1 in a state where the development cartridge 2 is mounted on the main body 1. The communicating portion 8 may be provided at a position close to a front portion 1-2 of the main body 1. Since the front portion 1-2 faces a user, the user may easily access the communicating portion 8. Accordingly, a toner refilling operation through the communicating portion 8 may be easily performed. The communicating portion 8 may be formed in a top surface 1-1 of the main body 1. The toner refilling portion 10 is located under the communicating portion 8. The communicating portion 8 and the toner refilling portion 10 may be vertically aligned with each other. The toner refill cartridge 9 may access the toner refilling portion 10 from the top of the main body 1 through the communicating portion 8.

For example, when the toner refill cartridge 9 is inserted from the top of the main body 1 into the communicating portion 8, as shown in FIG. 3, the toner refill cartridge 9 may be connected to the toner refilling portion 10. When the plunger 93 is pressed in a direction A1 in a state where the toner refill cartridge 9 is mounted on the toner refilling portion 10, toner received in the main body 91 may be discharged through the toner discharge portion 94 and may be supplied to the toner container 230 of the development cartridge 2 through the toner refilling portion 10. The toner refill cartridge 9 is removed from the communicating portion 8 after the toner is refilled.

In this configuration, since the toner container 230 may be refilled with toner through the toner refilling portion 10, a replacement time of the development cartridge 2 may be extended until a lifetime of the photosensitive drum 21 ends, thereby reducing printing costs per sheet. Since toner may be refilled in a state where the development cartridge 2 is mounted on the main body 1, user convenience may be improved.

Figure 4:
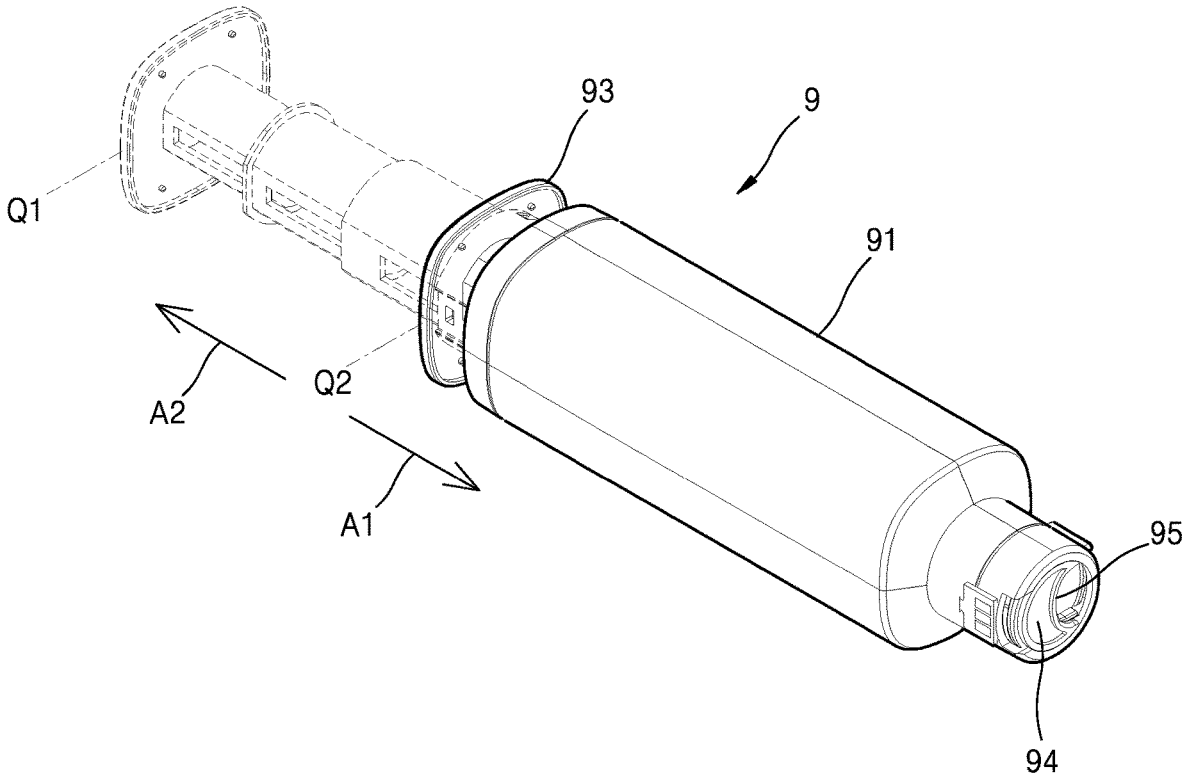
FIG. 4 is a perspective view of a toner refill cartridge according to an example.
Figure 5:
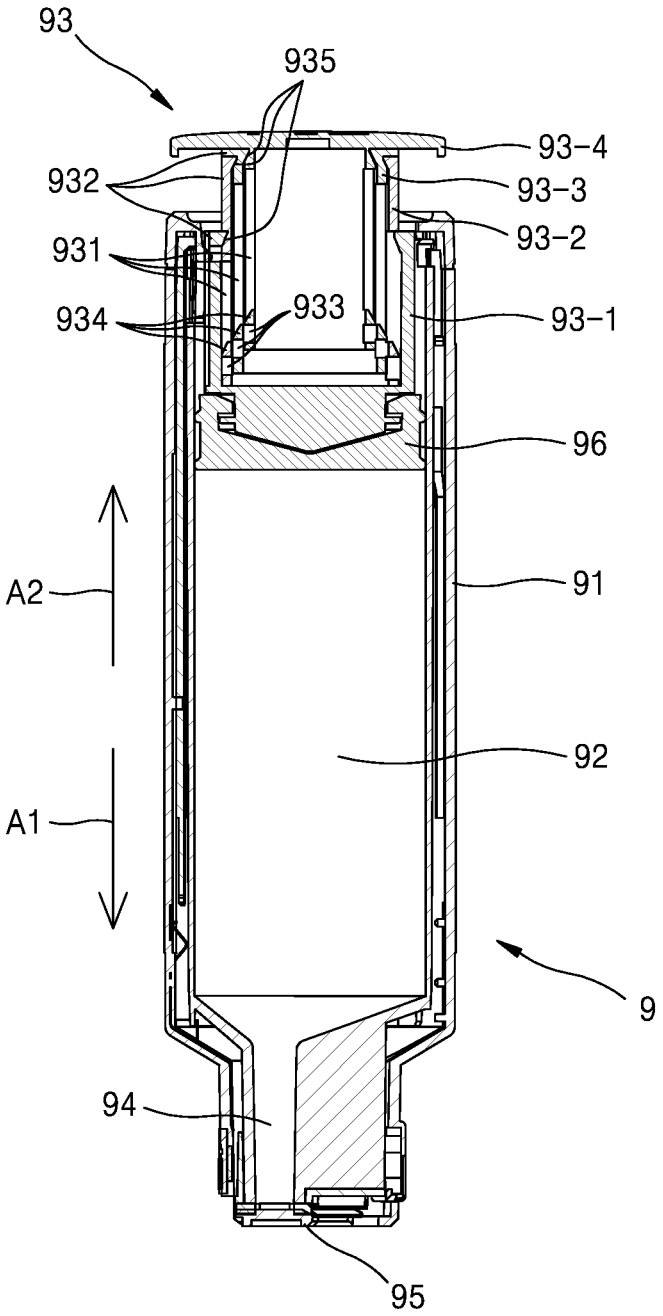
FIG. 5 is a cross-sectional view of the toner refill cartridge according to an example, illustrating a retraction state of a plunger.
Figure 6:
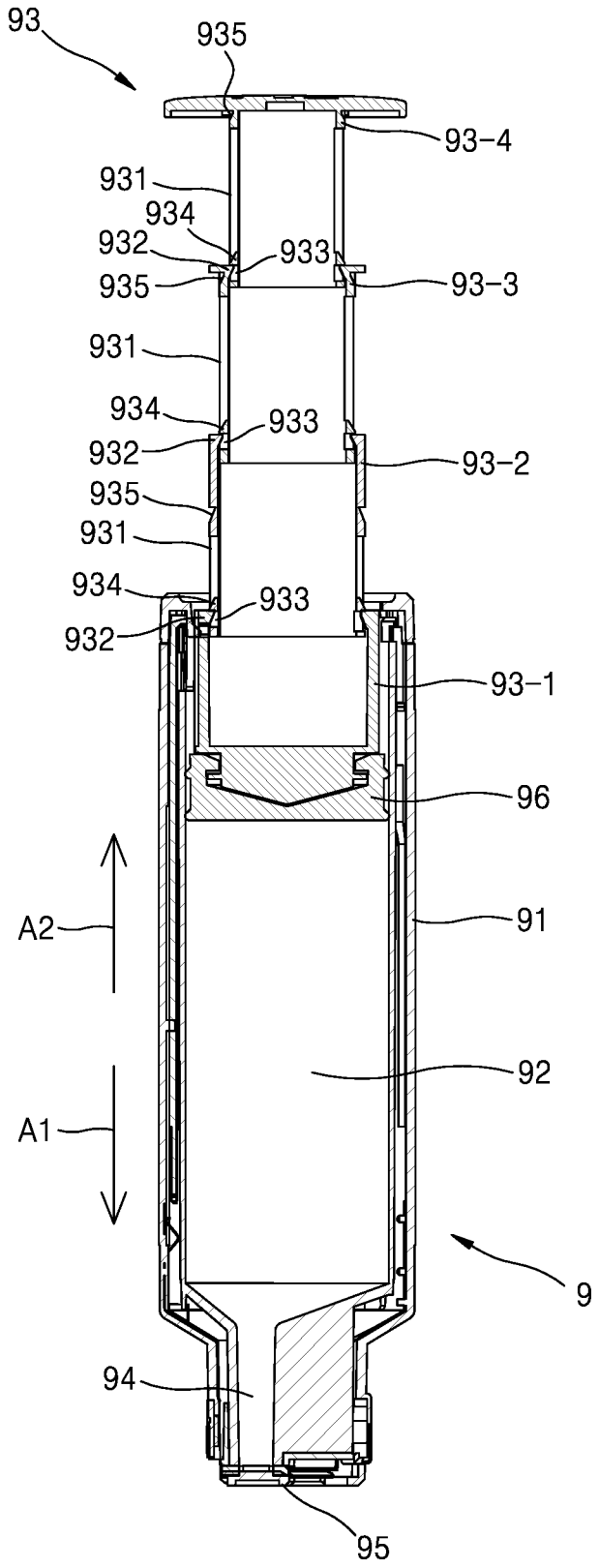
FIG. 6 is a cross-sectional view of the toner refill cartridge according to an example, illustrating an extension state of the plunger.

In the syringe-type toner refill cartridge 9, the plunger 93 may be located at a top dead position Q1 (see FIG. 1) at an initial time. In order to refill the toner container 230 with toner, the plunger 93 may be moved to a bottom dead position Q2 (see FIG. 1). Packing costs and transportation costs of the toner refill cartridge 9 may greatly depend on a size of the toner refill cartridge 9. When the toner refill cartridge 9 is distributed in a state where the plunger 93 is located at the top dead position Q1, a size of the toner refill cartridge 9 may be large and thus packing costs and transportation costs may be increased. In the example, the plunger 93 that may be switched from a retraction state to an extension state is used to reduce packing costs and transportation costs of the toner refill cartridge 9. FIG. 4 is a perspective view of the toner refill cartridge 9 according to an example. FIGS. 5 and 6 are cross-sectional views of the toner refill cartridge 9 according to an example, respectively illustrating a retraction state of the plunger 93 and an extension state of the plunger 93.

Referring to FIGS. 4, 5, and 6, the toner refill cartridge 9 may include the main body 91 including an inner space 92 in which toner is received and the toner discharge portion 94 through which the toner is discharged, a piston 96 coupled to the main body 91 to be movable in the first direction A1 along the inner space 92 and configured to push the toner through the toner discharge portion 94 to the outside of the main body 91, and the plunger 93 configured to push the piston 96 in the first direction A1. The plunger 93 may include a plurality of segment members 93-1, 93-2, 93-3, and 93-4. At least two adjacent segment members from among the plurality of segment members 93-1, 93-2, 93-3, and 93-4 may be switched between a retraction state where the segment members overlap each other in the first direction A1 and an extension state where the segment members extend in a second direction A2 that is opposite to the first direction A1. For example, all of the plurality of segment members 93-1, 93-2, 93-3, and 93-4 may be switched between the retraction state where the segment members overlap each other in the first direction A1 and the extension state where the segment members extend in the second direction A2 that is opposite to the first direction A1. The toner refill cartridge 9 may include a first locking portion for locking the plurality of segment members 93-1, 93-2, 93-3, and 93-4 so as not to be switched from the extension state to the retraction state.

Toner is received in the inner space 92. The toner discharge portion 94 is connected to the inner space 92 and is located on a front end portion of the main body 91, that is, an end portion in the first direction A1. A discharge shutter 95 selectively opens the toner discharge portion 94. For example, before the toner refill cartridge 9 is mounted on the toner refilling portion 10, the discharge shutter 95 may be located at a position for closing the toner discharge portion 94. When the toner refill cartridge 9 is mounted on the toner refilling portion 10, the discharge shutter 95 may be switched to a discharge position for opening the toner discharge portion 94.

The piston 96 is inserted into the inner space 92 from a second directional end portion of the inner space 92, and is movable in the first direction A1. For example, the piston 96 may be formed of an elastic material such as rubber so as to be closely contact to an inner wall of the inner space 92.

The plunger 93 includes the plurality of segment members 93-1, 93-2, 93-3, and 93-4. The segment member 93-1 located at the front in the first direction A1 is connected to the piston 96. For example, the piston 96 may be coupled to the segment member 93-1. Each of the plurality of segment members 93-1, 93-2, 93-3, and 93-4 may have a hollow tubular shape.

From among two adjacent segment members of the plurality of segment members 93-1, 93-2, 93-3, and 93-4, a segment member close to the piston 96, that is, a segment member located at a side in the first direction A1, is referred to as a preceding segment member, and a segment member located at a side in the second direction A2 with respect to the preceding segment member is referred to as a following segment member. For example, from among two adjacent segment members 93-2 and 93-3, the segment member 93-2 is a preceding segment member and the segment member 93-3 is a following segment member.

For example, as shown in FIG. 5, the retraction state of the plunger 93 may be a state where a following segment member is inserted into the inside of a preceding segment member and the preceding segment member and the following segment member overlap each other. In this case, a cross-sectional area of the preceding segment member perpendicular to the first direction A1 is greater than that of the following segment member so that the following segment member is accommodated in the preceding segment member. That is, cross-sectional areas of the plurality of segment members 93-1, 93-2, 93-3, and 93-4 perpendicular to the first direction A1 decrease away from the piston 96. As shown in FIG. 6, the extension state of the plunger 93 may be a state where the following segment member escapes from the inside of the preceding segment member in the second direction A2 and extends in the second direction A2. In this configuration, since the plunger 93 is in the retraction state during distribution, a size of the toner refill cartridge 9 is small, thereby reducing packing costs and transportation costs.

For example, although not shown, the retraction state may be a state where a following segment member is moved in the first direction A1 while surrounding an outer surface of a preceding segment member and the preceding segment member and the following segment member overlap each other. In this case, a cross-sectional area of the following segment member perpendicular to the first direction A1 is greater than that of the preceding segment member so that the preceding segment member is accommodated in the following segment member. That is, cross-sectional areas of the plurality of segment members 93-1, 93-2, 93-3, and 93-4 perpendicular to the first direction A1 increase away from the piston 96. The extension state may be a state where the following segment member escapes from the outer surface of the preceding segment member in the second direction A2 and extends in the second direction A2.

The plunger 93 switched between the retraction state where a following segment member is inserted into the inside of a preceding segment member and the preceding segment member and the following segment member overlap each other and the extension state where the following segment member escapes from the inside of the preceding segment member in the second direction A2 and extends in the second direction A2 will now be described.

Referring to FIGS. 5 and 6, in order to stably switch from the retraction state to the extension state of the plunger 93, a guide rail 931 linearly extending in the first direction A1 (or the second direction A2) may be provided on one of a preceding segment member and a following segment member and a guide boss 932 guided by the guide rail 931 may be provided on the remaining one of the preceding segment member and the following segment member. For example, the guide rail 931 may be provided on the following segment member and the guide boss 932 may be provided on the preceding segment member, or vice versa. In FIGS. 5 and 6, the guide rail 931 is provided on the following segment member and the guide boss 932 is provided on the preceding segment member.

The guide rail 931 may have a shape linearly extending in the first direction A1. The guide rail 931 may pass through each of the segment members 93-2, 93-3, and 93-4 having tubular shapes, or may be sunken from an outer wall of each of the segment members 93-2, 93-3, and 93-4. The guide boss 932 may inwardly protrude from each of the segment members 93-2, 93-3, and 93-4 and may be inserted into the guide rail 931.

In this configuration, when the segment member 93-4 is pulled in the second direction A2, the segment members 93-2, 93-3, and 93-4 may respectively extend from the segment members 93-1, 93-2, and 93-3 in the second direction A2 and may be switched to the extension state as shown in FIG. 6. Accordingly, the plunger 93 may be located at the top dead position Q1 of FIG. 1, and a stroke for moving the piston 96 in the first direction A1 to refill the toner container 230 with toner may be secured.

In the extension state, the plunger 93 may be pushed in the first direction A1 to move the piston 96 in the first direction A1. In this case, it is necessary to prevent the plunger 93 from being switched to the retraction state. To this end, the toner refill cartridge 9 may include the first locking portion. For example, the first locking portion may include a first locking groove 933 into which the guide boss 932 is inserted in the extension state. The first locking groove 933 may be spaced apart from a first directional end portion of the guide rail 931 in the first direction A1. The guide rail 931 and the first locking groove 933 may be separated from each other by a separating wall 934. When the plunger 93 is switched from the retraction state to the extension state, the guide boss 932 elastically crosses the separating wall 934 and is inserted from the guide rail 931 into the first locking groove 933, and the plunger 93 is locked in the extension state. Since the guide boss 932 is located at a second directional end portion of each of the segment members 93-2, 93-3, and 93-4, the second directional end portion of each of the segment members 93-2, 93-3, and 93-4 is slightly widened in a radial direction, and thus the guide boss 932 may elastically cross the separating wall 934 and may be inserted into the first locking groove 933. Although not shown, an elastic arm may be integrally formed with each of the segment members 93-2, 93-3, and 93-4, and the guide boss 932 may be provided on an end portion of the elastic arm.

Figure 7:
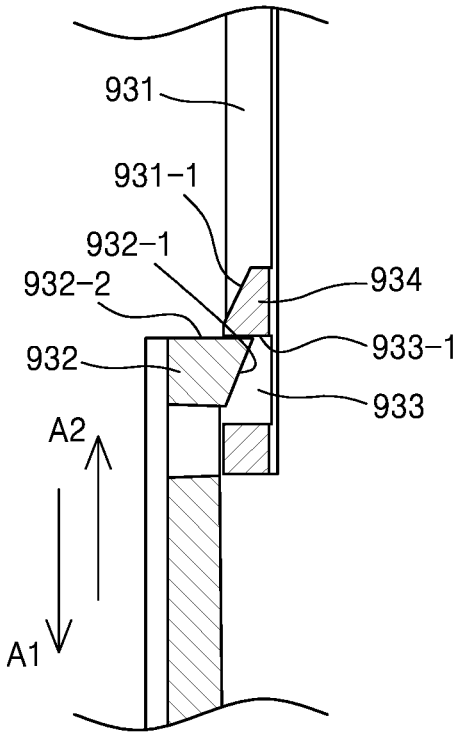
FIG. 7 is a cross-sectional view illustrating a state where a first locking groove and a guide boss are coupled to each other in the extension state of the plunger, according to an example.

FIG. 7 is a cross-sectional view illustrating a state where the first locking groove 933 and the guide boss 932 are coupled to each other in an extension state of the plunger 93, according to an example. Referring to FIG. 7, at least one of a surface of an end portion 931-1 of the guide rail 931 close to the first locking groove 933 and a surface 932-1 of the guide boss 932 facing the end portion 931-1 may be an inclined surface that is inclined so that the guide boss 932 is separated from the guide rail 931. Accordingly, when the plunger 93 is switched from a retraction state to an extension state, the guide boss 932 may be easily separated from the guide rail 931 and may be inserted into the first locking groove 933. In the example, both the surface of the end portion 931-1 of the guide rail 931 and the surface 932-1 of the guide boss 932 are inclined surfaces.

When the plunger 93 is pushed in the first direction A1 in a state where the guide boss 932 is inserted into the first locking groove 933, a surface 932-2 of the guide boss 932 and a surface 933-1 of the first locking groove 933 may contact each other and may prevent the plunger 93 from being switched from the extension state to the retraction state. An inclination angle of the surface 932-2 of the guide boss 932 and the surface 933-1 of the first locking groove 933 with respect to the first direction A1 may be equal to or less than 90°. In the example, an inclination angle of the surface 932-2 of the guide boss 932 and the surface 933-1 of the first locking groove 933 with respect to the first direction A1 is 90°.

In the retraction state, the guide boss 932 of each of the segment members 93-1, 93-2, and 93-3 may escape from the guide rail 931 provided on each of the segment members 93-2, 93-3, and 93-4 may elastically contact an outer circumferential surface of each of the segment members 93-2, 93-3, and 93-4. Due to contact pressure, the segment members 93-2, 93-3, and 93-4 may be maintained in the retraction state. When the segment member 93-4 is pushed in the second direction A2 with a force greater than a resistive force caused by the contact pressure, the segment members 93-2, 93-3, and 93-4 may respectively extend from the segment members 93-1, 93-2, and 93-3 and the plunger 93 may be switched to the extension state.

The toner refill cartridge 9 may include a second locking portion for locking the plunger 93 in the retraction state. Referring to FIG. 5, the second locking portion may include a second locking groove 935 formed in each of the segment members 93-2, 93-3, and 93-4 so that the guide boss 932 provided on each of the segment members 93-1, 93-2, and 93-3 is inserted into the second locking groove 935 in the retraction state. The second locking groove 935 may be concavely formed in or may pass through an outer circumferential surface of each of the segment members 93-1, 93-2, and 93-3.

In this configuration, a process of refilling the toner container 230 with toner will now be described briefly.

The toner refill cartridge 9 is distributed in a state where the plunger 93 is in the retraction state. Due to the contact pressure or the second locking portion, the plunger 93 may be maintained in the retraction state. When the toner container 230 is to be refilled with toner, the toner refill cartridge 9 is mounted on the toner refilling portion 10 through the communicating portion 8. Before or after the toner refill cartridge 9 is mounted on the toner refilling portion 10, the plunger 93 is switched to the extension state. Then, the guide boss 932 is inserted into the first locking groove 933 and the plunger 93 is locked in the extension state. In the extension state, the plunger 93 may be located at the top dead position Q1 of FIG. 1, and a stroke for moving the piston 96 in the first direction A1 may be secured. In the extension state, the plunger 93 is pushed in the first direction A1 to move the piston 96 in the first direction A1. When the plunger 93 reaches the bottom dead position Q2, refilling of toner is completed. Next, the toner refill cartridge 9 is separated from the toner refilling portion 10.

Although the segment members 93-2, 93-3, and 93-4 are linearly moved in the second direction A2 and the plunger 93 is switched from the retraction state to the extension state in the above example, the segment members 93-2, 93-3, and 93-4 may be rotated and moved in the second direction A2, and the plunger 93 may be switched from the retraction state to the extension state.

Figure 8:
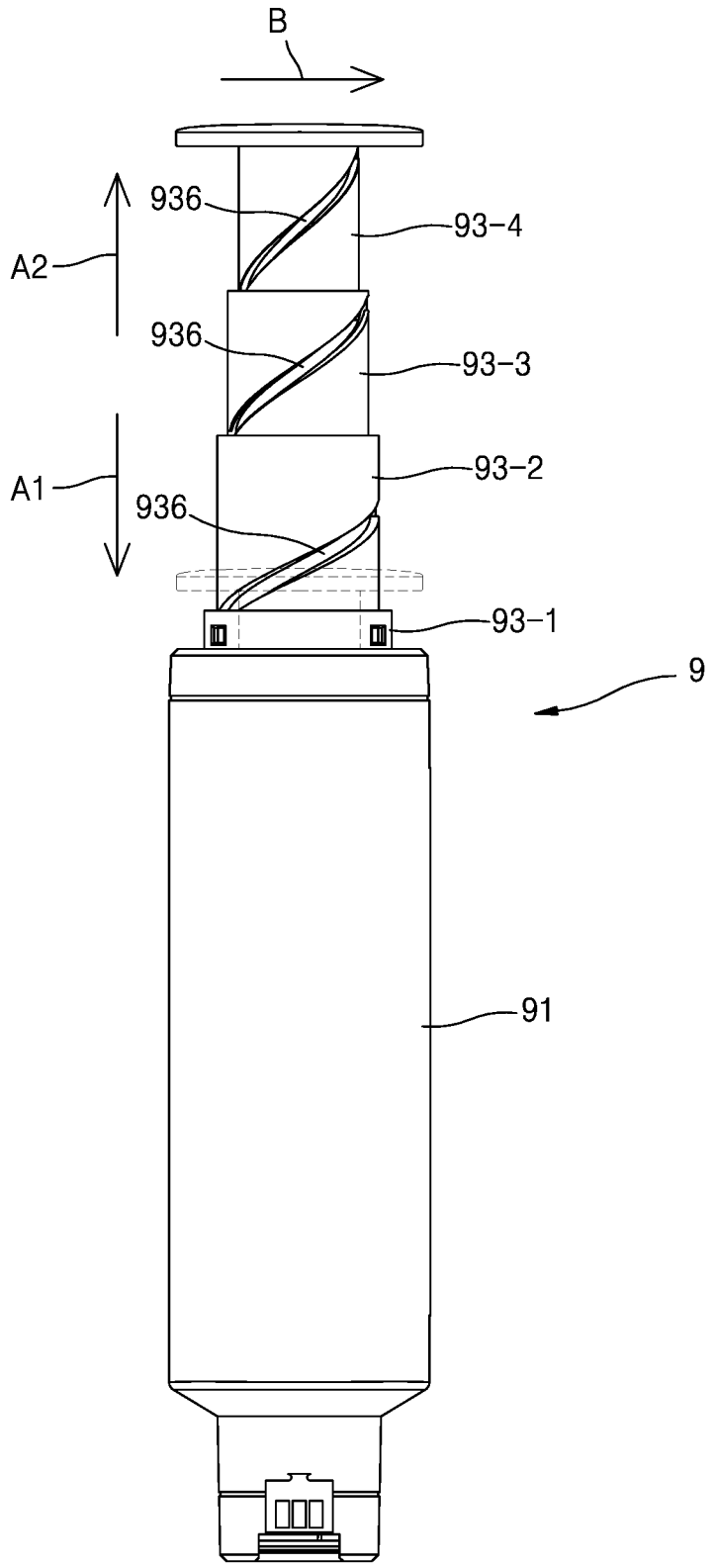
FIG. 8 is a plan view of the toner refill cartridge according to an example, illustrating an extension state of the plunger.
Figure 9:
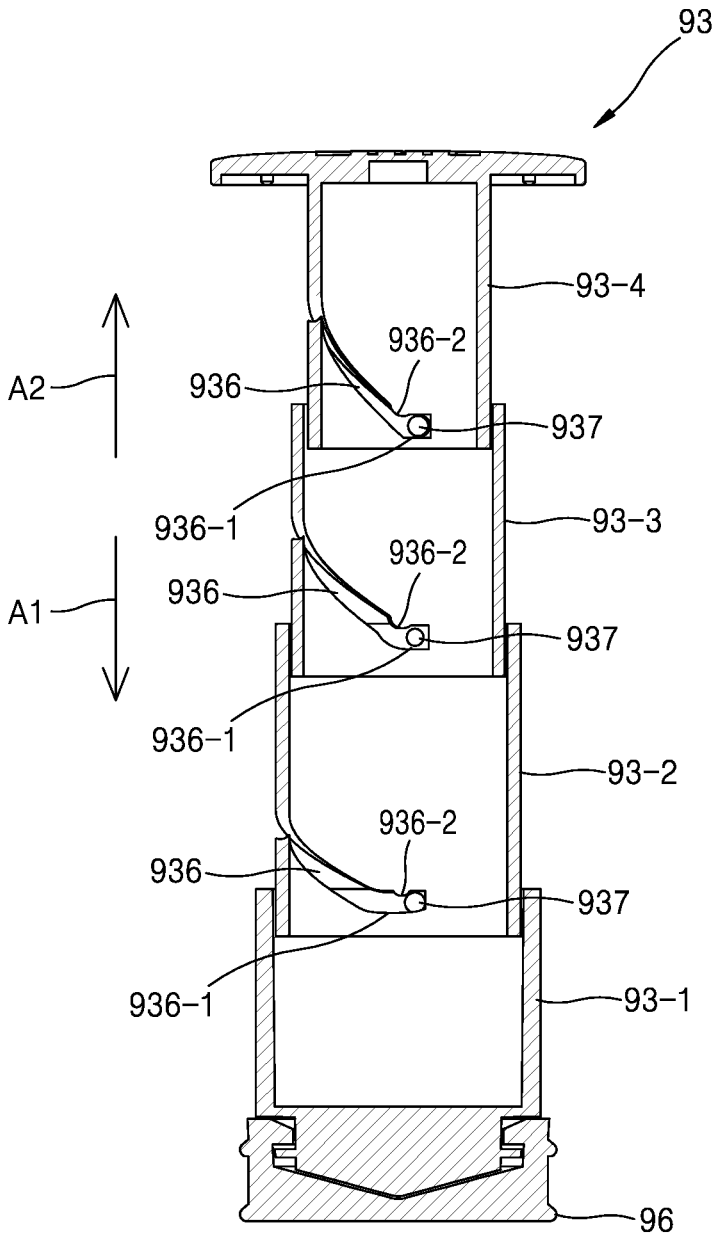
FIG. 9 is a cross-sectional view of the plunger in the extension state.

FIG. 8 is a plan view of the toner refill cartridge 9 according to an example, illustrating an extension state of the plunger 93. FIG. 9 is a cross-sectional view of the plunger 93 in the extension state. Referring to FIGS. 8 and 9, a guide rail 936 that spirally extends in the first direction A1 (or the second direction A2) may be provided on any of a preceding segment member and a following segment member, and a guide boss 937 that is guided by the guide rail 936 may be provided on the remaining one of the preceding segment member and the following segment member. For example, the guide rail 936 may be provided on the following segment member and the guide boss 937 may be provided on the preceding segment member, or vice versa. In FIGS. 8 and 9, the guide rail 936 is provided on the following segment member and the guide boss 937 is provided on the preceding segment member. In this configuration, the plunger 93 may be switched from a retraction state (marked by a dashed line of FIG. 8) to an extension state (marked by a solid line of FIG. 8) that extends in the second direction A2 by rotating the plunger 93 in a direction B.

A first locking portion may include a support groove 936-1 formed in an end portion of the guide rail 936 to support the guide boss 937 in the extension state. The support groove 936-1 may extend from the end portion of the guide rail 936 in a direction perpendicular to the first direction A1. Accordingly, even when the plunger 93 is pressed in the first direction A1, the plunger 93 may be locked in the extension state without being switched to the retraction state.

The first locking portion may further include a separation preventing protrusion 936-2. The separation preventing protrusion 936-2 is located between the end portion of the guide rail 936 and the support groove 936-1. The separation preventing protrusion 936-2 forms a bottleneck portion between the end portion of the guide rail 936 and the support groove 936-1. Since the segment members 93-2, 93-3, and 93-4 are rotated when the plunger 93 is switched from the retraction state to the extension state, the guide boss 937 elastically widens the bottleneck portion and is inserted from the guide rail 936 into the support groove 936-1. Since the support groove 936-1 extends in a direction perpendicular to the first direction A1 even when a force is applied to the plunger 93 in the first direction A1 in the extension state, the plunger 93 may be maintained in the extension state without being switched to the retraction state. Also, since the separation preventing protrusion 936-2 prevents the plunger 93 from being rotated, the plunger 93 may be more stably maintained in the extension state.

While the disclosure has been shown and described with reference to examples thereof, they are provided for illustration and it will be understood by one of ordinary skill in the art that various modifications and equivalent other examples may be made from the disclosure. Accordingly, the technical scope of the disclosure is defined by the technical spirit of the appended claims.

What is claimed is:

1. A toner refill cartridge, comprising:

a main body including an inner space to receive toner and a toner discharge portion to discharge the toner;

a piston coupled to the main body to be movable in a first direction along the inner space to push the toner outside of the main body through the toner discharge portion;

a plunger to push the piston in the first direction, the plunger including a plurality of segment members, wherein at least two adjacent segment members from among the plurality of segment members are switchable from a retraction state where the at least two adjacent segment members overlap each other in the first direction to an extension state where the at least two adjacent segment members extend in a second direction opposite to the first direction; and a locking portion to lock the at least two adjacent segment members in the extension state to prevent the at least two adjacent segment members from switching to the retraction state.

2. The toner refill cartridge of claim 1, wherein the plurality of segment members have hollow tubular shapes, a first cross-sectional area perpendicular to the first direction of a first segment member among the plurality of segment members is less than a second cross-sectional area perpendicular to the first direction of a second segment member among the plurality of segment members, and the first segment member is farther away from the piston than the second segment member.

3. The toner refill cartridge of claim 1, wherein the at least two adjacent segment members include a preceding segment member adjacent to the piston and a following segment member located at a side in the second direction with respect to the preceding segment member and insertable into the preceding segment member, and the toner refill cartridge further comprises:

a guide rail linearly extending in the first direction provided on one of the preceding segment member and the following segment member; and a guide boss guided by the guide rail provided on the other one of the preceding segment member and the following segment member.

4. The toner refill cartridge of claim 3, wherein the locking portion includes a locking groove formed in the one of the preceding segment member and the following segment member so that the guide boss is inserted into the first locking groove when the at least two adjacent segment members are in the extension state.

5. The toner refill cartridge of claim 4, wherein at least one of a surface of an end portion of the guide rail adjacent to the locking groove or a surface of the guide boss facing the end portion of the guide rail has an inclined surface to separate the guide boss from the guide rail.

6. The toner refill cartridge of claim 5, wherein an inclination angle of another surface of the guide boss and a surface of the first locking groove, which contact each other when the plunger is pushed in the first direction in a state where the guide boss is inserted into the locking groove, with respect to the first direction, is equal to or less than 90°.

7. The toner refill cartridge of claim 3, further comprising another locking portion to lock the at least two adjacent segment members in the retraction state.

8. The toner refill cartridge of claim 1, wherein the at least two adjacent segment members include a preceding segment member adjacent to the piston and a following segment member located at a side in the second direction with respect to the preceding segment member and insertable into the preceding segment member, and the toner refill cartridge further comprises:

a guide rail spirally extending in the first direction provided on one of the preceding segment member and the following segment member; and a guide boss guided by the guide rail provided on the other one of the preceding segment member and the following segment member.

9. The toner refill cartridge of claim 8, wherein the locking portion includes a support groove formed in an end portion of the guide rail to support the guide boss when the at least two adjacent segment members are in the extension state.

10. The toner refill cartridge of claim 9, wherein the locking portion includes a separation preventing protrusion to form a bottleneck portion between the end portion of the guide rail and the support groove to prevent the guide boss from being separated from the support groove.

11. A toner refill cartridge, comprising:

a main body to receive toner therein and including a toner discharge portion to discharge the toner;

a piston coupled to the main body to be movable in a first direction and to push the toner outside of the main body through the toner discharge portion;

a plunger to push the piston in the first direction and including a preceding segment member adjacent to the piston and a following segment member, the plunger being movable between a retraction state where the preceding segment member and the following segment member overlap each other and an extension state where the following segment member extends from the preceding segment member in a second direction opposite to the first direction; and a locking portion to lock the preceding segment member such that the plunger is maintained in the extension state as the piston is pushed in the first direction.

12. The toner refill cartridge of claim 11, further comprising:

a guide rail provided on the following segment member and linearly extending in the second direction; and a guide boss provided on the preceding segment member and guided by the guide rail.

13. The toner refill cartridge of claim 12, wherein the locking portion includes a locking groove formed in an end portion of the guide rail so that the guide boss is inserted into the locking groove when the plunger is in the extension state.

14. The toner refill cartridge of claim 11, further comprising:

a guide rail provided on the following segment member and spirally extending in the second direction; and a guide boss provided on the preceding segment member and guided by the guide rail.

15. The toner refill cartridge of claim 14, wherein the locking portion includes:

a support groove formed in an end portion of the guide rail to support the guide boss when the plunger is in the extension state, and a separation preventing protrusion to form a bottleneck portion between the end portion of the guide rail and the support groove to prevent the guide boss from being separated from the support groove.

* * * * *